US008911021B1

(12) United States Patent
Styke

(10) Patent No.: US 8,911,021 B1
(45) Date of Patent: Dec. 16, 2014

(54) APPARATUS FOR RAISING AND LOWERING A HUMAN FOOT

(71) Applicant: Paul Styke, Canton, MI (US)

(72) Inventor: Paul Styke, Canton, MI (US)

( * ) Notice: Subject to any disclaimer, the term of this patent is extended or adjusted under 35 U.S.C. 154(b) by 0 days.

(21) Appl. No.: 14/032,992

(22) Filed: Sep. 20, 2013

(51) Int. Cl.
*A47C 16/00* (2006.01)
*A47C 7/50* (2006.01)

(52) U.S. Cl.
CPC ..... *A47C 7/506* (2013.01)
USPC ..... 297/423.45; 297/423.46

(58) Field of Classification Search
USPC ..... 297/423.45, 423.46, 423.44, 423.41, 297/339
See application file for complete search history.

(56) References Cited

U.S. PATENT DOCUMENTS

| | | | | |
|---|---|---|---|---|
| 38,619 | A * | 5/1863 | Wilkins | 297/423.45 |
| 360,855 | A * | 4/1887 | Cooper | 297/383 |
| 3,284,817 | A * | 11/1966 | Landwirth | 5/647 |
| 4,232,901 | A * | 11/1980 | Harrington et al. | 297/423.45 |
| 4,786,032 | A | 11/1988 | Garman et al. | |
| 5,285,992 | A * | 2/1994 | Brown | 248/421 |
| 6,089,667 | A * | 7/2000 | Hobbs | 297/423.12 |
| 6,158,552 | A * | 12/2000 | Gould et al. | 182/200 |
| 6,422,653 | B1 | 7/2002 | Szczepanski et al. | |
| 6,450,581 | B1 | 9/2002 | Koerlin | |
| 6,871,364 | B1 | 3/2005 | Leoutsakos | |
| 7,097,241 | B2 * | 8/2006 | Tally et al. | 297/118 |
| 7,360,841 | B2 | 4/2008 | Barlow et al. | |
| 7,966,947 | B2 * | 6/2011 | Roleder | 108/3 |
| 8,616,652 | B1 * | 12/2013 | Wells | 297/423.39 |
| 2003/0071508 | A1 * | 4/2003 | Lu | 297/423.43 |
| 2010/0090513 | A1 * | 4/2010 | Behmer et al. | 297/423.41 |
| 2010/0163055 | A1 | 7/2010 | Wilkinson | |

FOREIGN PATENT DOCUMENTS

| | | | |
|---|---|---|---|
| DE | 4442039 | A1 | 12/1995 |
| EP | 0574188 | A1 | 12/1993 |
| GB | 2450894 | A | 1/2009 |

* cited by examiner

*Primary Examiner* — Milton Nelson, Jr.
(74) *Attorney, Agent, or Firm* — Gifford, Krass, Sprinkle, Anderson & Citkowski, P.C.

(57) ABSTRACT

An apparatus for lifting an adult human foot includes a frame, a foot rest, and a lifting mechanism. The frame is configured to rest on a floor with the lifting mechanism being positioned on the frame and the foot rest being secured to the lifting mechanism. In operation, the lifting mechanism functions to selectively raise and lower the foot rest with respect to the floor.

11 Claims, 5 Drawing Sheets

APPARATUS FOR RAISING AND LOWERING A HUMAN FOOT

FIELD OF THE INVENTION

An apparatus is disclosed that operates to selectively raise and lower an adult human foot, particularly when the subject adult is seated.

BACKGROUND OF THE INVENTION

Anyone who has experienced a lower back injury knows that the injury can render difficult many of the body movements that make up daily life. The simple act of putting on socks, for example, becomes small feat when your back hurts so much that you cannot lift your leg high enough for your arms to reach your toes. The same goes for people who are overweight or physically infirm. Persons in those categories may lack the physical strength or otherwise be physically incapable of sufficiently flexing their bodies to reach their feet.

There are, of course, devices to help people lift their feet. The most common are handheld poles or extensions, but those devices require the user to have at least a reasonable degree of dexterity and physical strength to work—characteristics that may be lacking in the physically infirm. There are also devices that can automatically elevate a leg, such as the device disclosed by U.S. Pat. No. 6,871,364. However, the prior art automatic lifts all appear to be directed to helping lift a user's legs, not feet. Many automatic lifts are also attached to another object such as a hospital bed or a wheelchair.

SUMMARY OF THE INVENTION

An apparatus is disclosed for reciprocally raising and lowering an adult human foot. In one embodiment the apparatus includes a frame, a foot rest, and a lifting mechanism. The frame is configured to rest on the floor (for example next to a chair). The lifting mechanism is positioned on the frame with the foot rest being mounted to the lifting mechanism. The lifting mechanism operates to selectively and reciprocally raise and lower the foot rest in with respect to the floor. The foot rest may be pivotably secured to the lifting mechanism and dimensioned to support a single adult human foot. The apparatus may be portable and self-contained.

BRIEF DESCRIPTION OF THE DRAWINGS

Reference will know be made to the associated drawings wherein like (or similar) reference numerals refer to like (or similar) parts throughout, and wherein.

DETAILED DESCRIPTION OF THE PREFERRED EMBODIMENT

Disclosed herein are various embodiments of an apparatus for lifting a human foot, a preferably an adult human foot. The apparatus is, for example, configured to lift a single adult human foot and dimensioned so that the user may keep his or her other foot on the floor. An apparatus that is intended to raise both of a user's feet at the same time being disfavored.

In one embodiment, the apparatus may include a frame, a foot rest, and a lifting mechanism. The frame is configured to rest on a floor (or like surface) with the lifting mechanism being positioned on the frame. The foot rest is mounted to the lifting mechanism. In addition, the frame may include an exterior cover that may be constructed of a soft and/or fabric material (e.g., leather or vinyl), or alternatively a rigid material (e.g., plastic). In operation, the lifting mechanism functions to selectively raise and lower the foot rest with respect to the floor. For example, in one embodiment the foot rest may travel substantially vertically (i.e., at about a right angle) with respect to the floor. In another embodiment the foot rest frame may travel at an angle anywhere between 45 and 90 degrees with respect to the floor.

Figure 1:
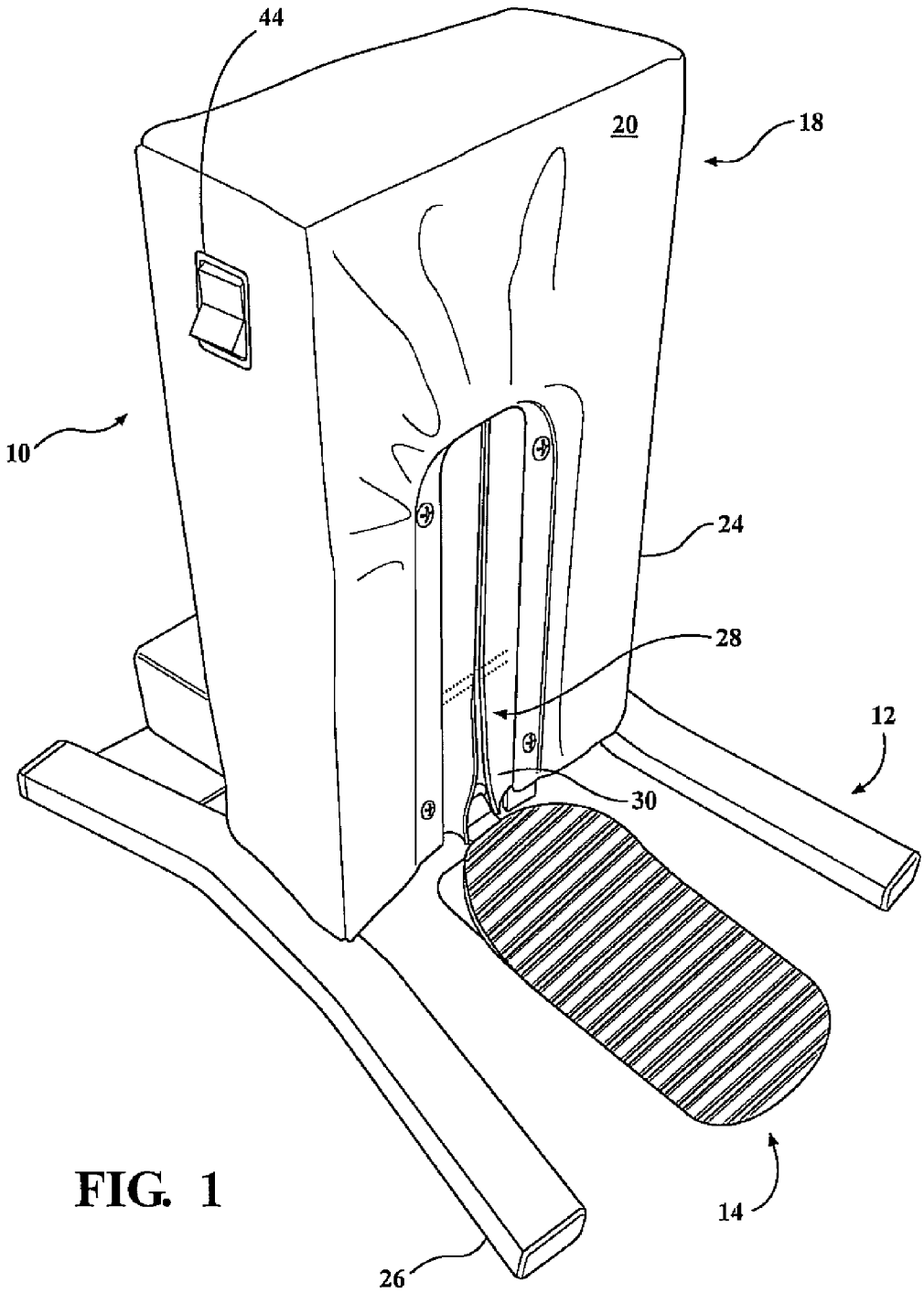
FIG. 1 is a front perspective view of one embodiment of an apparatus for raising and lowering an adult human foot, and showing the apparatus including a soft and/or fabric cover exterior.

Referring now to FIGS. 1 though 5, embodiments of an apparatus 10 are disclosed for lifting an adult human foot 100. In one embodiment (FIGS. 1-3), the apparatus 10 may include a frame 12, a foot rest 14, and a lifting mechanism 16. The frame 12 is configured to rest on a floor (or like support surface)(not shown) with the lifting mechanism 16 being positioned on the frame 12. The foot rest 14 is mounted to the lifting mechanism 16. In addition, the frame 12 may include an exterior cover 18 that may be constructed of a soft and/or fabric material 20 (e.g., leather or vinyl), or alternatively (see FIG. 4) a rigid material 22 (e.g., plastic). In operation, the lifting mechanism 16 functions to selectively raise and lower the foot rest 14 so that the foot rest 14 travels up or down the with respect to the to the floor (not shown). More specifically, in one embodiment (see FIGS. 1-3) the foot rest 14 may travel substantially vertically with respect to the floor (not shown). However, in other embodiments (see FIG. 5) the foot rest 14 may travel at an angle between about 45 and 90 degrees with respect to the floor (not shown).

Still referring to FIGS. 1-5, the frame 12 may include a body 24 and support legs 26. The body 24, for example, may be constructed of a simple rectangular metal skeleton box frame (not shown). The frame 12 may be enclosed by the exterior cover 18 and have dimensions of about 40 cm×22 cm. As mentioned above, in some embodiments (see FIGS. 1-3) the exterior cover 18 may be constructed of a soft and/or fabric material 20 (e.g., leather or vinyl). However, in other embodiments (see FIG. 4) the exterior cover 18 may be constructed single molded unit of ridged material 22 (e.g., plastic). It will be appreciated that in some environments, such as hospitals or the like, the use unitary out shell (see FIG. 4) may result in the apparatus 10 being easier to clean and disinfect.

The support legs 26 may be fixed to one end of the body 24 so that they rest on the floor (not shown) with the body 24 being supported on and extending upwardly from the legs 26. For example, as shown in FIGS. 1-4, the body 24 may be supported on the legs 26 in a substantially vertical (e.g., at about right angle) orientation with respect to the legs 26 (and thus the floor). However, as shown in FIG. 5, the body 24 may alternatively be tilted (either in a fixed or pivotable manner) with respect to the legs 26 (and thus the floor) so that the body 24 is at an angle between about 45 and 90 degrees with respect to the legs 26 (and thus the floor). In addition, as will be discussed further below, in at least the disclosed embodiments the position of the foot rest 14 with respect to the floor follows from the orientation of the body 24.

Still referring to FIGS. 1-5, the exterior cover 18 for the frame 12 may (as will be discussed further below) may include an aperture or channel 28 to allow for travel of the lifting mechanism 16 and foot rest 14. Protective flaps 30, such as rubber flanges or bristles of the kind well known in the art may be mounted to the cover and extend across the channel 28 to deter the infiltration of dust or objects into the interior of the body 24.

Referring now to FIGS. 1 though 5, the lifting mechanism 16 may, for example, be constructed from an assembly of elements including a pair of parallel tracks 32, a bracket 34 that is mounted to and operable run along the tracks 32, a rack 36 positioned parallel to the tracks 32, an electric motor 38 positioned on the bracket 34, at least one pinion gear 40 rotatably mounted to the motor 38 and configured to engage the rack 36, a power supply 42, and a three position switch 44. The motor 38 may, for example, be a 210 series, deer head, 12v reversing actuator motor of the type commercially available from A.M. Equipment. Further, as shown in FIGS. 1 through 4, the power supply 42 may include a rechargeable battery positioned external to the cover 18 on a support plate that extends between the legs of the frame 12. However, as shown in FIG. 5, the power supply 42 may alternatively be a rechargeable battery positioned on the frame 12 and internal to the cover 18. It will also be appreciated that the apparatus 10 may be configured to simply plug into a standard wall socket (not shown) or use other known power supply systems (e.g., solar, etc.).

Figure 2:
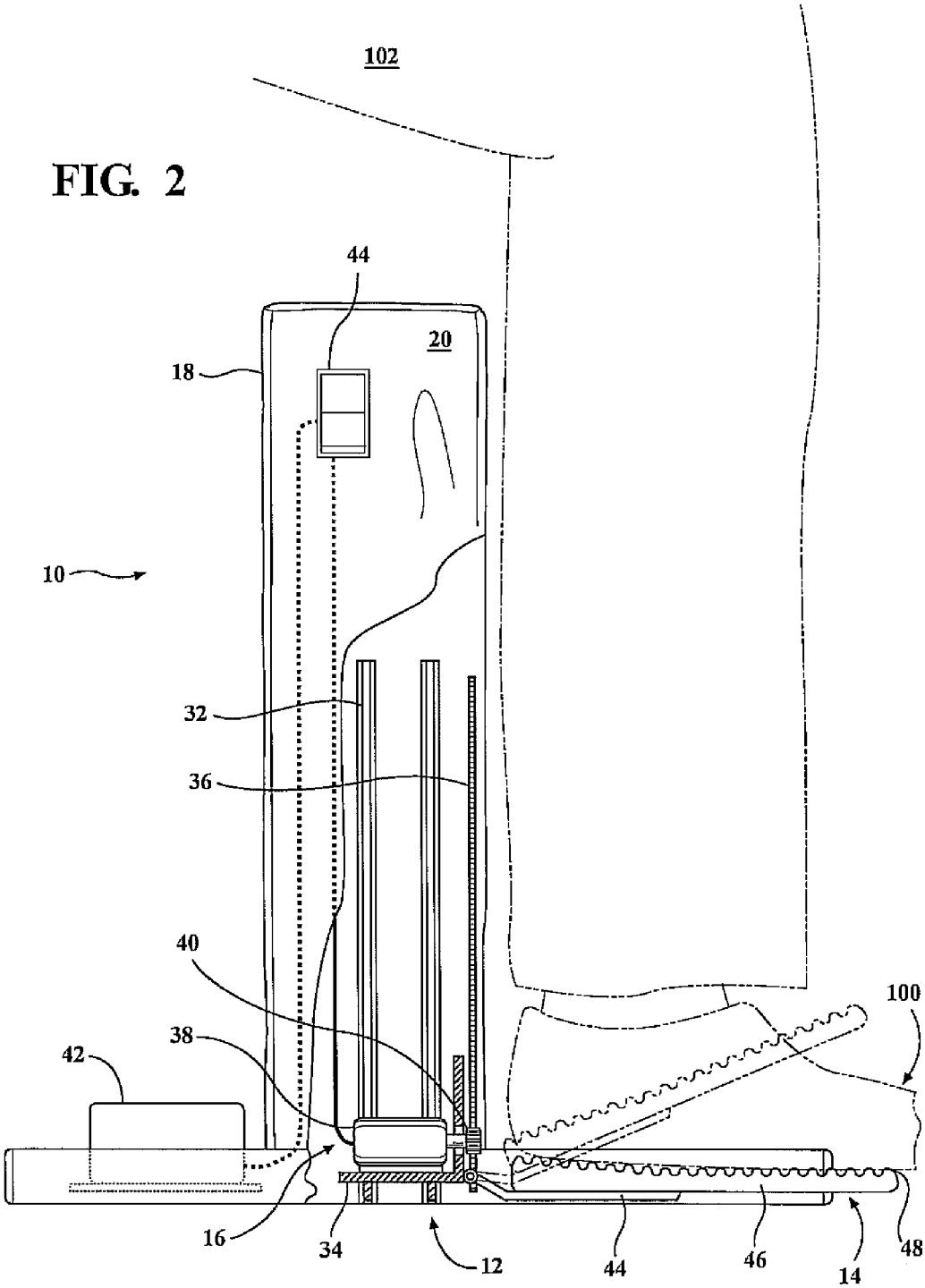
FIG. 2 is a planar and cutaway view from the left side of the apparatus of FIG. 1 in which shown an embodiment of the internal mechanics of the apparatus, and in which the foot is show in the lowered position.
Figure 3:
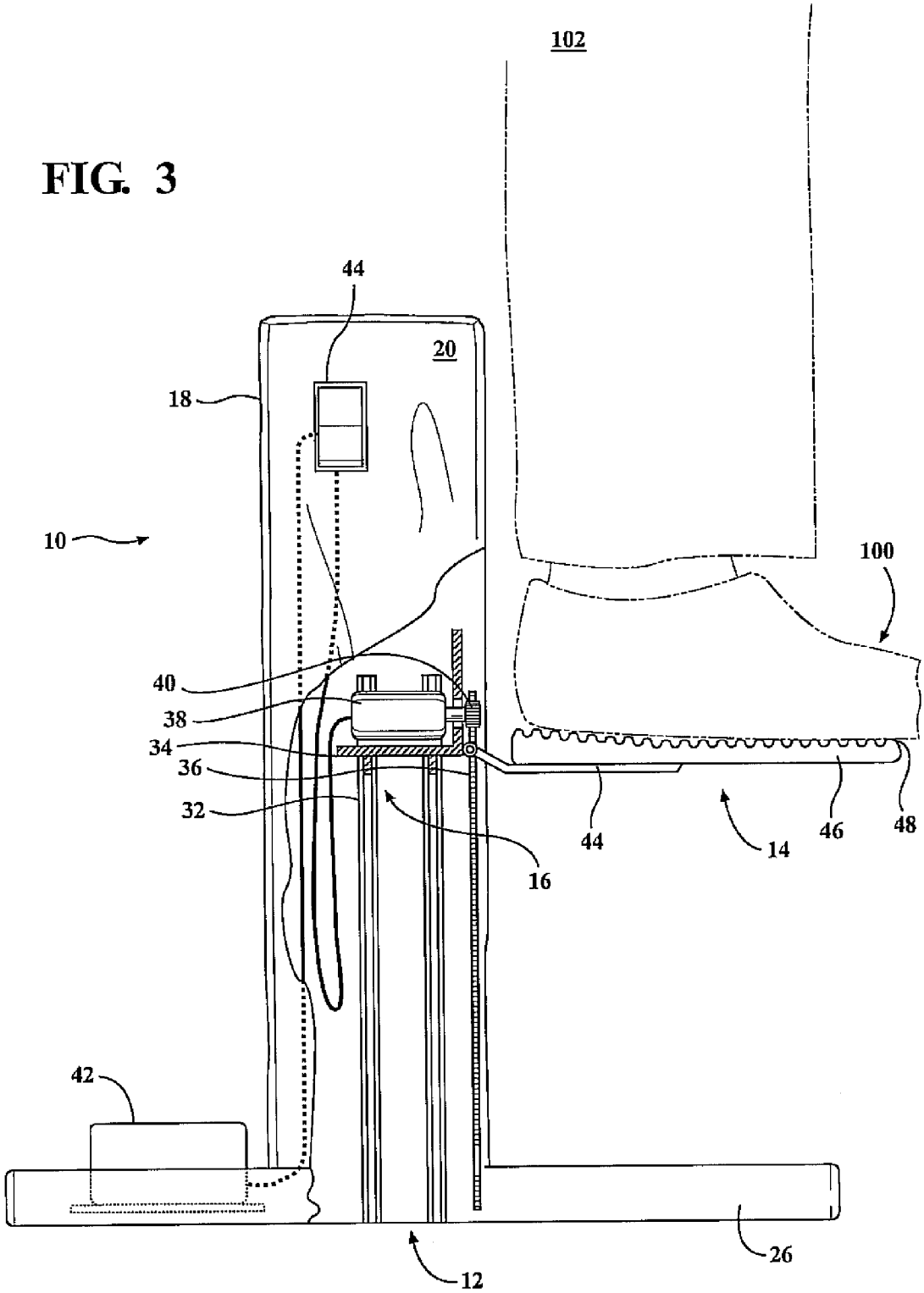
FIG. 3 is a planar and cutaway view from the left side of the apparatus of FIG. 1 in which shown an embodiment of the internal mechanics of the apparatus, and in which the foot is show in the raised position.
Figure 4:
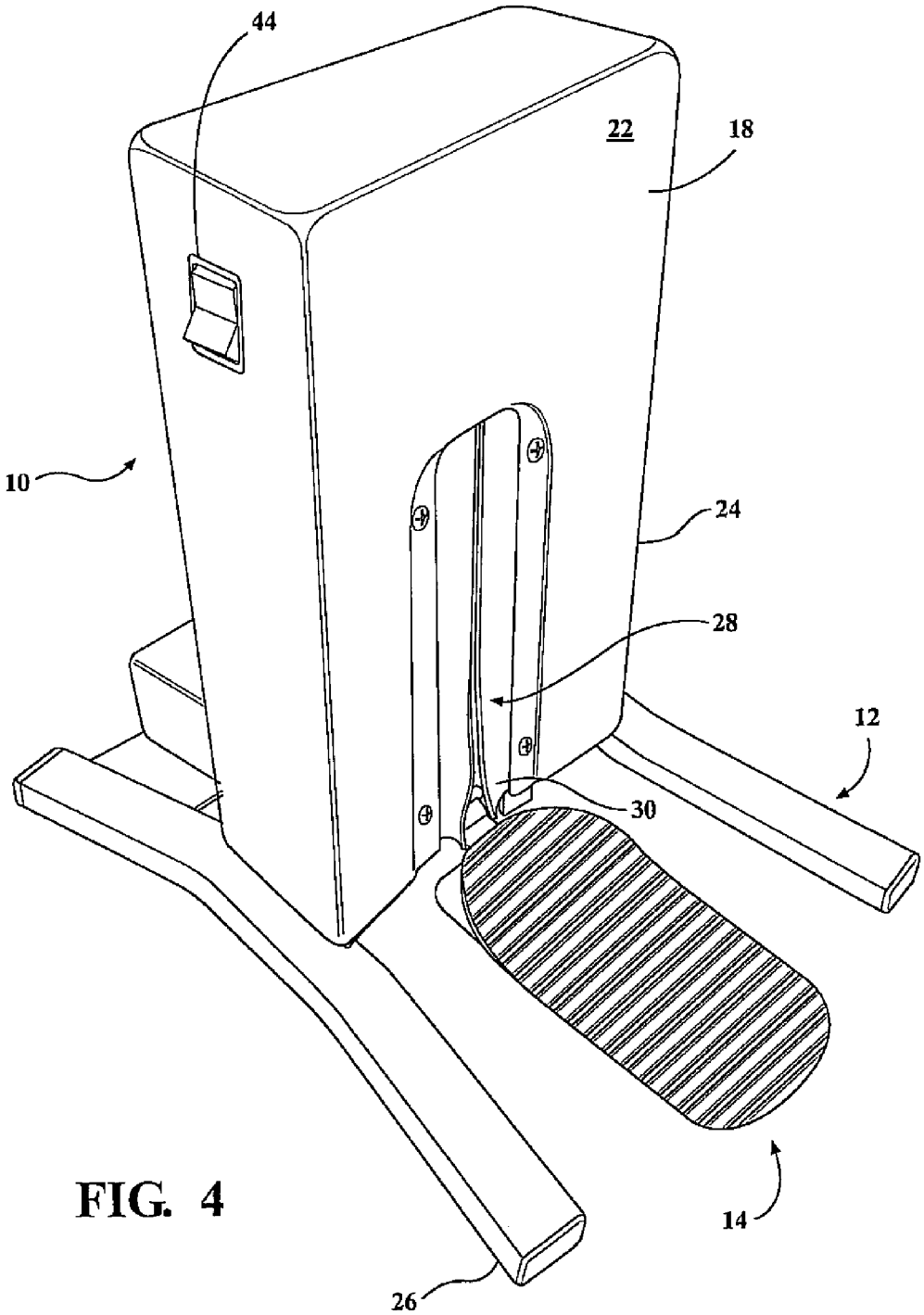
FIG. 4 is a front perspective view of one embodiment of an embodiment of an apparatus for raising and lowering an adult human foot, and showing the apparatus including a rigid exterior.
Figure 5:
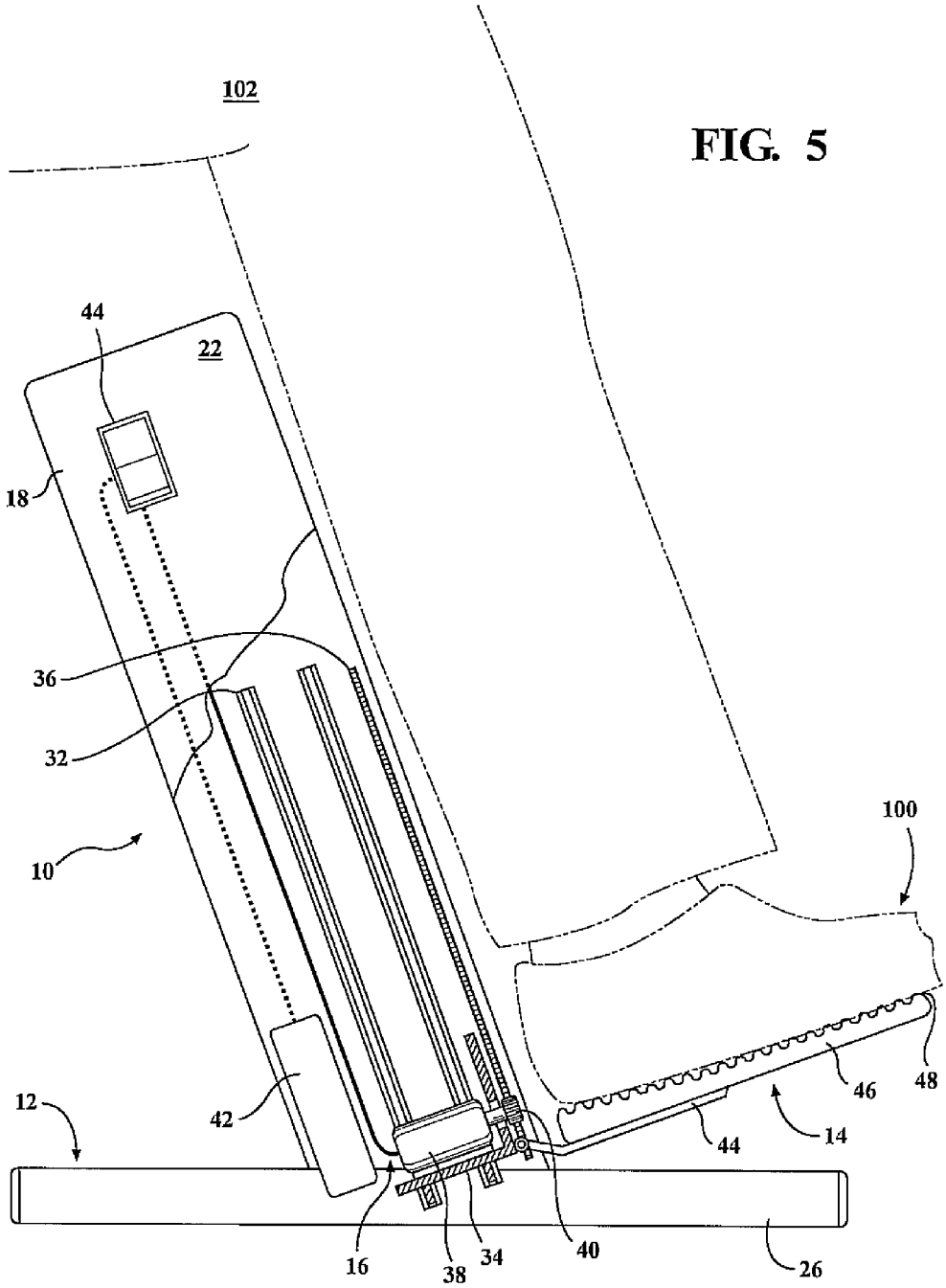
FIG. 5 is a planar and cutaway view from the left side of an embodiment of an apparatus for raising and lowering an adult human foot in which a frame for the apparatus is shown tilted with respect to a base.

As shown in FIGS. 1 through 5, the foot rest 14 may include a mounting plate 44 and a tread portion 46. The mounting plate 44, as best shown in FIG. 2, may (optionally) be pivotably mounted to the bracket 34 of the lift mechanism 16. The upper surface 48 of the tread portion 46 may, as shown in FIGS. 1 through 5, may include friction members and be dimensioned to support a single adult human foot. More specifically, it is noted that in 1994 Hawes and Sovak observed an average foot length of 26.3 cm with a standard deviation of 1.2 cm from a study of 1197 North American adult Caucasian males (mean age 35.5 years). See Hawes M R, Sovak D (July 1994). "Quantitative morphology of the human foot in a North American population". Ergonomics 37 (7): 1213-26. Accordingly, in one embodiment the foot rest 14 (or at least in the disclosed embodiments the upper surface 48 of the tread portion 46) may have a length in the range of about 10 to 45 cm. However, in another embodiment the length of the foot rest 14 may be in a range between 15 and 30 cm. And, in another embodiment the length of the foot rest 14 may be between about 21 and 22 cm.

A reasonable estimation for an average human foot width can also be generally derived from the average length data using, to a certain degree, common sense and also other available research data. Accordingly, a width of the foot rest 14, which should be wide enough to support one adult human foot but not two, may in one embodiment be in the range of about 6 to 15 cm. And, in another embodiment the width of the foot rest 14 may be about 10 to 12 cm.

In operation, the frame 12 may be positioned on a floor (not shown) and next to a chair (not shown) or other seating apparatus. A user 102, who is seated in the chair, positions one of his or her feet 100 on the foot rest 14 and activates the lifting mechanism 16 by operation of the switch 44. Specifically, in the disclosed embodiments, activation of the switch 44 results in the selective reciprocal raising or lowering of the foot rest 14 by the lifting mechanism 16 relative to the floor.

The illustrated embodiments are not intended to be limiting on the scope of the present invention. Changes therein, other combinations of elements, and other uses will occur to those skilled in the art.

I claim:

1. An apparatus comprising:

a frame including a base, a front face and a rear face, a pair of side walls and a top;

a foot rest having a foot engagement surface; and a lifting mechanism positioned on said frame, with the foot rest being mounted to the lifting mechanism so that the foot engagement surface extends substantially outwardly from said front face of said frame, and the lifting mechanism including a motor, a rechargeable battery electrically connected to the motor, a rack and a pinion gear and the lifting mechanism selectively raising and lowering the foot engagement surface so that the foot engagement surface travels a predetermined distance between the top and base of the frame and along the front face.

2. The apparatus of claim 1, further comprising a switch positioned on one side wall of said pair of side walls proximate the top of the frame, the switch operating to selectively control the lifting mechanism.

3. The apparatus of claim 1, further comprising the frame including at least one support leg and the frame being pivotably mounted to the support leg.

4. The apparatus of claim 1, wherein the foot rest is pivotably mounted to the lifting mechanism.

5. The apparatus of claim 4, wherein the foot rest supports only one human foot.

6. The apparatus of claim 5, wherein the foot rest has a length in a range of 10 to 45 cm and a width in a range of 6 to 15 cm.

7. The apparatus of claim 5, wherein the frame comprises a support leg and a body that is pivotably mounted to the support leg.

8. An apparatus comprising:

a frame including a base, a face and a rear face, a pair of side walls, a top and at least one support leg, the frame being pivotably mounted to the support leg;

a foot rest having a foot engagement surface; and a lifting mechanism positioned on said frame, with the foot rest supporting only one human foot and being pivotably mounted to the lifting mechanism so that the foot engagement surface extends substantially outwardly from said front face of said frame, and the lifting mechanism including a motor, a rechargeable battery electrically connected to the motor, a rack and a pinion gear and the lifting mechanism selectively raising and lowering the foot engagement surface substantially vertically with respect to the base.

9. The apparatus of claim 8, wherein the foot rest has a length in a range of 10 to 45 cm and a width in a range of 6 to 15 cm.

10. The apparatus of claim 8, wherein the foot rest has a length in a range of 15 to 30 cm and a width in a range of 6 to 15 cm.

11. The apparatus of claim 8, further comprising a switch positioned on one of said pair of side walls proximate the top of the frame, the switch operating to selectively control the lifting mechanism.

* * * * *